252-97 AU 157 EX
3/24/87 XR 4,652,394

United States Patent [19]
Inamorato et al.

[11] Patent Number: 4,652,394
[45] Date of Patent: Mar. 24, 1987

[54] BUILT SINGLE PHASE LIQUID ANIONIC DETERGENT COMPOSITIONS CONTAINING STABILIZED ENZYMES

[75] Inventors: Jack T. Inamorato, Westfield; Michael C. Crossin, Kendall Park, both of N.J.

[73] Assignee: Colgate Palmolive Co., New York, N.Y.

[21] Appl. No.: 870,645

[22] Filed: May 29, 1986

Related U.S. Application Data

[63] Continuation of Ser. No. 728,151, Apr. 29, 1985, abandoned, which is a continuation of Ser. No. 677,634, Dec. 3, 1984, abandoned, which is a continuation of Ser. No. 499,645, May 13, 1983, abandoned.

[51] Int. Cl.[4] ..... C11D 9/10; C11D 3/00; C11D 7/10

[52] U.S. Cl. ..... 252/174.12; 252/97; 252/109; 252/139; 252/DIG. 12; 252/DIG. 14

[58] Field of Search ..... 252/97, 109, 139, 174.12, 252/DIG. 12, DIG. 14

[56] References Cited

U.S. PATENT DOCUMENTS 4,169,817 10/1979 Weber ..... 252/174.12 X
4,243,543 1/1981 Guilbert et al. ..... 252/174.12 X

FOREIGN PATENT DOCUMENTS 2079305 1/1982 United Kingdom .

*Primary Examiner*—John E. Kittle
*Assistant Examiner*—Mukund J. Shah
*Attorney, Agent, or Firm*—B. Lieberman; M. M. Grill; H. S. Sylvester

[57] ABSTRACT

A stabilized built single-phase enzyme-containing liquid detergent composition is provided comprising:

(a) from about 8 to 20%, by weight, of one or more surface active anionic detergent compounds;
(b) from about 5 to 25%, by weight, of a water-soluble non-phosphate detergent builder salt;
(c) an effective amount of an enzyme or enzyme mixture selected from the group consisting of alkaline protease enzymes and alpha-amylase enzymes;
(d) an enzyme stabilizing system containing, based on the weight of the detergent composition, (i) from about 12 to 25% of propylene glycol and (ii) from about 1 to 5% of a boron compound selected from the group consisting of boric acid, boric oxide and alkali metal borates; and
(e) from about 25 to 75%, by weight, water.

15 Claims, No Drawings

BUILT SINGLE PHASE LIQUID ANIONIC DETERGENT COMPOSITIONS CONTAINING STABILIZED ENZYMES

This application is a continuation of application Ser. No. 728,151, filed Apr. 29, 1985, now abandoned, which is a continuation of Ser. No. 677,634, filed Dec. 3, 1984, now abandoned, which is a continuation of Ser. No. 499,645, filed May 13, 1983, now abandoned.

This invention relates to stable, built, enzyme-containing liquid detergent compositions suitable for laundry or pre-soak formulations. More particularly, the invention relates to aqueous enzyme-containing liquid detergent compositions which contain a non-phosphate detergent builder and which are characterized by being physically stable, clear, single-phase homogeneous liquid compositions.

The formulation of stabilized enzyme-containing liquid detergent compositions has been the focus of much attention in the prior art. The desirability of incorporating enzymes into detergent compositions is primarily due to the effectiveness of proteolytic and amylolytic enzymes in decomposing proteinaceous and starchy materials found on soiled fabrics, thereby facilitating the removal of stains, such as, gravy stains, blood stains, chocolate stains and the like during laundering. However, enzymatic materials suitable for laundry compositions, particularly proteolytic enzymes, are relatively expensive. Indeed, they generally are the most expensive ingredient in a typical commercial liquid detergent composition, even when present in relatively minor amounts. Moreover, enzymes are known to be unstable in aqueous compositions. It is for this reason that an excess of enzymes is generally required in liquid detergent formulations to compensate for the expected loss of enzyme activity during prolonged periods of storage. Accordingly, the prior art is replete with suggestions for stabilizing enzyme-containing liquid detergent compositions, and in particular unbuilt liquid compositions by the use of various materials which are incorporated into the composition and serve as enzyme stabilizers.

In the case of liquid detergent compositions containing a builder, the problem of enzyme instability is particularly acute. Primarily this is because detergent builders have a destabilizing effect on enzymes, even in compositions containing enzyme stabilizers which are otherwise effective in unbuilt formulations. Moreover, the incorporation of a builder into a liquid detergent composition poses an additional problem, namely, the ability to form a stable single-phase solution, the solubility of sodium tripolyphosphate, for example, being relatively limited in aqueous compositions, and especially in the presence of anionic and nonionic detergents. Thus, for example, in U.K. Patent Application G.B. No. 2,079,305, published Jan. 20, 1982, there is disclosed an aqueous built enzyme-containing liquid detergent composition which is stabilized by a mixture of a polyol and boric acid. The compositions described in the examples, however, rather than being stable, clear, single-phase solutions, are instead turbid suspensions which are susceptible to product separation over prolonged periods of storage. Consequently, the problems of enzyme stability and physical product stability remain as problems yet to be overcome in formulating a commercially acceptable built enzyme-containing liquid detergent composition.

SUMMARY OF THE INVENTION

The present invention provides a stabilized aqueous, built, clear, single-phase, enzyme-containing liquid detergent composition comprising:

(a) from about 8 to 20%, by weight, of one or more surface active anionic detergent compounds;

(b) from about 5 to 25%, by weight, of a water-soluble non-phosphate detergent builder salt;

(c) an effective amount of an enzyme or enzyme mixture selected from the group consisting of alkaline protease enzymes and alpha-amylase enzymes;

(d) an enzyme stabilizing system containing based on the weight of the detergent composition (i) from about 12 to 25% of propylene glycol and (ii) from about 1 to 5% of a boron compound selected from the group consisting of boric acid, boric oxide and alkali metal borates; and (e) from about 25 to 75%, by weight, water.

In accordance with the process of the invention, laundering of stained and/or soiled materials is effected by contacting such materials with an aqueous solution of the above-defined liquid detergent composition. Unlike the built, enzyme-containing detergent compositions known in the art, the compositions of the present invention are characteristically clear, single-phase homogeneous solutions which are physically stable over prolonged periods of storage and over a wide range of temperature. To avoid product separation, the present compositions are preferably substantially free of a phosphate builder salt.

Unlike the enzyme-containing built liquid anionic detergent compositions disclosed in the art, the anionic surfactant in the present compositions is solubilized in the presence of a builder salt. Moreover, the present enzyme-containing compositions are characterized by the presence of an enzyme-stabilizing system which in addition to providing long-term stability to the enzyme over a wide range of temperatures, serves to enhance the solubility of the anionic surfactant and the non-phosphate builder in the aqueous composition allowing a physically stable single-phase solution to be formed for the particular range of compositions indicated.

DETAILED DESCRIPTION OF THE INVENTION

The enzyme stabilizing system of the invention is a mixture of propylene glycol and a boron compound selected from among boric acid, boric oxide and alkali metal borate capable of reacting with propylene glycol. The amount of propylene glycol is from about 12 to 25%, preferably from about 15 to 20%, by weight, and the amount of the boron compound may vary from about 1 to 5%, preferably from about 1 to 3%, by weight of the composition.

The alkaline proteolytic enzymes suitable for the present compositions include the various commercial liquid enzyme preparations which have been adapted for use in detergent compositions, enzyme preparations in powdered form being also useful although, as a general rule, less convenient for incorporation into the build liquid detergent compositions. Thus, suitable liquid enzyme preparations include "Alcalase" and "Esperase" sold by Novo Industries, Copenhagen, Denmark, and "Maxatase" and "AZ-Protease" sold by Gist-Brocades, Delft, The Netherlands. Esperase is particularly preferred for the present composition because of its optimized activity at the higher pH values corresponding to built detergent compositions.

Among the suitable α-amylase liquid enzyme preparations are those sold by Novo Industries and Gist-Brocades under the tradenames "Termamyl" and "Maxamyl", respectively.

The synthetic anionic detergent employed in the practice of the invention may be any of a wide variety of such compounds which are well known and are described at length in the test *Surface Active Agents*, Vol. II, by Schwartz, Perry and Berch, published in 1958 by Interscience Publishers, the disclosures pertaining to such detergent being hereby incorporated by reference.

The most preferred anionic detergent compounds are the higher (10 to 18 or 20 carbon atoms) alkyl benzene sulfonate salts wherein the alkyl group preferable contains 10 to 15 carbon atoms, most preferably being a straight chain alkyl radical of 12 or 13 carbon atoms. Preferably, such an alkyl benzene sulfonate has a high content of 3- (or higher) phenyl isomers and a correspondingly low content (usually well below 50%) of 2- (or lower) phenyl isomers; in other words, the benzene ring is preferably attached in large part at the 3, 4, 5, 6 or 7 position of the alkyl group and the content of isomers in which the benzene ring is attached at the 1 or 2 position is correspondingly low. Typical alkyl benzene sulfonate surface active agents are described in U.S. Pat. No. 3,320,174. Of course, more highly branched alkyl benzene sulfonates may also be employed but usually are not preferred, due to their lack of biodegradeability.

Other anionic detergents which are useful are the olefin sulfonate salts. Generally, these contain long chain alkenyl sulfonates or long chain hydroxyalkane sulfonates (with the OH being on the carbon atom which is not directly attached to the carbon atom bearing the —$SO_3H$ group). The olefin sulfonate detergent usually comprises a mixture of such types of compounds in varying amounts, often together with long chain disulfonates or sulfate-sulfonates. Such olefin sulfonates are described in patents, such as U.S. Pat. Nos. 2,061,618; 3,409,637; 3,332,880; 3,420,875; 3,428,654; 3,506,580; and British Pat. No. 1,129,158. The number of carbon atoms in the olefin sulfonate is usually within the range of 10 to 25, more commonly 10 to 18 or 20, e.g., a mixture principally of $C_{12}$, $C_{14}$ and $C_{16}$, having an average of about 14 carbon atoms, or a mixture principally of $C_{14}$, $C_{16}$ and $C_{18}$, having an average of about 16 carbon atoms.

Another class of useful anionic detergents is that of the higher paraffin sulfonates. These may be primary paraffin sulfonates made by reacting long chain alpha-olefins and bisulfites, e.g., sodium bisulfite, or paraffin sulfonates having the sulfonate groups distributed along the paraffin chain, such as the products made by reacting a long chain paraffin with sulfur dioxide and oxygen under ultraviolet light, followed by neutralization with sodium hydroxide or other suitable base (as in U.S. Pat. Nos. 2,503,280; 2,507,088; 3,260,741; 3,372,188; and German Pat. No. 735,096). The paraffin sulfonates preferably contain from 13 to 17 carbon atoms and will normally be the monosulfonate but if desired, may be di-, tri- or higher sulfonates. Typically, the di- and polysulfonates will be employed in admixture with a corresponding monosulfonate, for example, as a mixture of mono- and disulfonates containing up to about 30% of the disulfonate. The hydrocarbon substituent thereof is preferably linear but if desired, branched chain paraffin sulfonates can be employed, although they are inferior with respect to biodegradability.

Other suitable anionic detergents are sulfated ethoxylated higher fatty alcohols of the formula $RO(C_2H_4O)_mSO_3M$, wherein R is a fatty alkyl of from 10 to 18 or 20 carbon atoms, m is from 2 to 6 or 8 (preferably having a value from about 1/5 to ½ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms.

Ethylene oxide is the preferred lower alkylene oxide of the anionic alkoxylate detergent, and the proportion thereof in the polyethoxylated higher alkanol sulfate is preferably 2 to 5 moles of ethylene oxide groups present per mole of anionic detergent, with three moles being most preferred, especially when the higher alkanol is of 11 or 12 to 15 carbon atoms. To maintain the desired hydrophile-lipophile balance, when the carbon atom content of the alkyl chain is in the lower portion of the 10 to 18 carbon atom range, the ethylene oxide content of the detergent may be reduced to about two moles per mole whereas when the higher alkanol is of 16 to 18 carbon atoms in the higher part of the range, the number of ethylene oxide groups may be increased to 4 or 5 and in some cases to as high as 8 or 9. Similarly, the salt-forming cation may be altered to obtain the best solubility. It may be any suitably solubilizing metal or radical but will most frequently be alkali metal, e.g., sodium, or ammonium. If lower alkylamine or alkanolamine groups are utilized the alkyls and alkanols will usually contain from 1 to 4 carbon atoms and the amines and alkanolamines may be mono-, di- and tri-substituted, as in menethanolamine, diisopropanolamine and trimethylamine.

The poly-lower alkoxy higher alkanol sulfates may be employed in combination with other preferred anionic detergents such as the higher alkyl benzene sulfonates to provide optimum detergency in the present built liquid detergent compositions. A preferred polyethoxylated alcohol sulfate detergent is available from Shell Chemical Company and is marketed as Neodol 25-3S.

Examples of higher alcohol polyethenoxy sulfates which may be employed in the liquid detergent compositions of the invention include: mixed $C_{12-15}$ normal or primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetra-ethenoxy sulfate, sodium salt; stearyl pentaethenoxy sulfate, trimethylamine salt; and mixed $C_{10-18}$ normal primary alkyl triethenoxy sulfate, potassium salt.

Other useful anionic detergents include the higher acyl sarcosinates, e.g., sodium N-lauroyl sarcosinate; higher fatty alcohol sulfates, such as sodium lauryl sulfate and sodium tallow alcohol sulfate; sulfated oils; sulfates of mono- or diglycerides of higher fatty acids, e.g., stearic monoglyceride monosulfate; although, of these, the sodium higher alcohol sulfates have been found to be inferior to the polyethoxylated sulfates in detergency; aromatic poly(lower alkenoxy)ether sulfates, such as the sulfates of the condensation products of ethylene oxide and nonylphenol (usually having 1 to 20 oxyethylene groups per molecule, preferably 2 to 12); polyethoxy higher alcohol sulfates and alkyl phenol polyethoxy sulfates having a lower alkoxy (of 1 to 4 carbon atoms, e.g., methoxy) substituent on a carbon close to that carrying the sulfate group, such as monomethyl ether monosulfate of a long chain vicinal glycol, e.g., mixture of vicinal alkane diols of 16 to 20 carbon atoms in a straight chain; acyl esters of isethionic acid, e.g., oleyl isethionates; acyl N-methyl taurides, e.g., potassium N-methyl lauroyl or oleyl taurides; higher alkyl phenyl polyethoxy sulfonates; higher alkyl phenyl polyethoxy sulfonates; higher alkyl phenyl disulfonates, e.g., pentadectyl phenyl disulfonate; and higher fatty acid soaps, e.g., mixed coconut oil and tallow soaps in a 1:4 ratio.

Among the aforementioned types of anionic detergents, the sulfates and sulfonates are generally preferred but the corresponding organic phosphates and phosphonates may also be employed when their contents of phosphorus are not objectionable. Generally, the water soluble anionic synthetic organic detergents, (including soaps), are salts of alkali metal cations, such as potassium, lithium, and especially sodium, although salts of ammonium and substituted ammonium cations, such as those previously described, e.g., triethanolamine, triisopropylamine, may also be used.

A nonionic detergent may optionally be employed in minor amounts to supplement the anionic detergent compound in the present built liquid detergent compositions. When used in such combination with an anionic detergent, the amount of nonionic detergent will generally be below about 10%, and preferably below about 5%, by weight, of the total composition.

The nonionic detergents are usually poly-lower alkoxylated lipophiles wherein the desired hydrophile-lipophile balance is obtained from addition of a hydrophilic poly-lower alkoxy group to a lipophilic moiety. For the present compositions the nonionic detergent employed is preferably a poly-lower alkoxylated higher alkanol wherein the alkanol is of 10 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 11 or 12 to 15 carbon atoms and which contain from 5 to 8 or 5 to 9 lower alkoxy groups per mole. Preferably, the lower alkoxy is ethoxy but in some instances it may be desirably mixed with propoxy, the latter, if present, usually being a minor (less than 50%) constituent. Exemplary of such compounds are those wherein the alkanol is of 12 to 15 carbon atoms and which contain about 7 ethylene groups per mole, e.g., Neodol® 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide groups per mole averages about 6.5. The higher alcohols ae primary alkanols. Other examples of such detergents include Tergitol® 15-S-7 and Tergitol 15-S-9, both of which are linear secondary alcohol ethoxylates made by Union Carbide Corporation. The former is a mixed ethoxylation product of an 11 to 15 carbon atom linear secondary alkanol with seven moles of ethylene oxide and the latter is a similar product but with nine moles of ethylene oxide being reacted.

Also useful in the present compositions are higher molecular weight non-ionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company. Other useful non-ionics are represented by Plurafac B-26 (BASF Chemical Company), the reaction product of a higher linear alcohol and a mixture of ethylene and propylene oxides.

In the preferred poly-lower alkoxylated higher alkanols, the best balance of hydrophilic and lipophilic moieties are obtained when the number of lower alkoxies are from about 40% to 100% of the number of carbon atoms in the higher alcohol, preferably 40 to 60% thereof. The nonionic detergent is preferably comprised of at least 50% of the preferred ethoxylated alkanols. Higher molecular weight alkanols and various other normally solid nonionic detergent compounds and surfactants may contribute to gelation of the liquid detergent composition and consequently, are normally omitted to limited in quantity in the present compositions, although minor proportions thereof may be employed for their cleaning properties, etc. With respect to both preferred and less preferred nonionic detergents, the alkyl groups present therein are preferably linear although a minor degree of slight branching may be tolerated, such as at a carbon next to or two carbons removed from the terminal carbon of the straight chain and away from the ethoxy chain with the proviso that such branched alkyl is no more than three carbons in length. Normally the proportion of carbon atoms in such a branched configuration will be minor, rarely exceeding 20% of the total carbon atom content of the alkyl. Similarly, although linear alkyls which are terminally joined to the ethylene oxide chains are highly preferred and are considered to result in the optimum combination of detergency, biodegradability and non-gelling characteristics, medial or secondary joinder to the ethylene oxide in the chain may occur. In such instance, it is usually in only a minor proportion of such alkyls, generally less than 20% but as is in the case of the aforementioned Tergitols, may be greater. Also, when propylene oxide is present in the lower alkylene oxide chain, it will usually be less than 20% thereof and preferably less than 10% thereof.

The non-phosphate detergent builder salts are employed in the present compositions in amounts generally of from about 5 to 25%, and preferably from about 10 to 20%, by weight. Specific examples of non-phosphorous water-soluble inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful and include the alkali metal, ammonium and substituted ammonium polyacetates, carboxylates, polycarboxylates and polyhydroxysulfonates. Specific examples of polyacetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

The percentage of water, the main solvent in the present compositions, will usually be from about 25 to 75%, preferably 40 to 60%, by weight, of the liquid composition.

The optical fluorescent brighteners or whiteners employed in the liquid detergent compositions are important constituents of modern detergent compositions which give washed laundry and materials a bright appearance so that the laundry is not only clean but also appears clean. Although it is possible to utilize a single brightener for a specific intended purpose in the present liquid detergent compositions it is generally desirable to employ mixtures of brighteners which will have good brightening effects on cotton, nylons, polyesters and blends of such materials and which are also bleach stable. A good description of such types of optical brighteners is given in the article "The Requirements of Present Day Detergent Fluorescent Whitening Agents" by A. E. Siegrist, J. Am. Oil Chemists Soc., January 1978 (Vol. 55). That article and U.S. Pat. No. 3,812,041, issued May 21, 1974, both of which are hereby incorporated by reference contain detailed descriptions of a wide variety of suitable optical brighteners.

Among the brighteners that are useful in the present liquid detergent compositions are: Calcofluor 5BM (American Cyanamid); Calcofluor White ALF (American Cyanamid); SOF A-2001 (Ciba); CDW (Hilton-Davis); Phorwite RKH, Phorwite BBH and Phorwite BHC (Verona); CSL, powder, acid (American Cyanamid); FB 766 (Verona); Blancophor PD (GAF); UNPA (Geigy); Tinopal RBS 200 (Geigy).

Adjuvants may be present in the liquid detergent compositions to provide additional properties, either functional or aesthetic. Included among the useful adjuvants are soil suspending or antiredeposition agents, such as polyvinyl alcohol, sodium carboxymethyl cellulose, hydroxypropylmethyl cellulose; thickeners, e.g., gums, alginates, agar agar; foam improvers, e.g., lauric myristic diethanolamide; foam destroyers, e.g., silicones; bactericides, e.g., tri-bromosalicyclanilide, hexachlorophene; dyes; pigments (water dispersible); preservatives; ultraviolet absorbers; fabric softeners; opacifying agents, e.g., polystyrene suspensions; and perfumes. Of course, such materials will be selected based on the properties desired in the finished product, their compatibility with the other constituents, and their solubility in the liquid composition.

The present liquid compositions are efficient and easy to use. Compared to heavy duty laundry detergent powders, much smaller volumes of the present liquids are employed to obtain comparable cleaning of soiled laundry. For example, using a typical preferred formulation of this invention, only about 132 grams or ½ cup of liquid is needed for a full tub of wash in a top-loading automatic washing machine in which the water volume is 15 to 18 gallons (55 to 75 liters); and even less is needed for front-loading machines. Thus, the concentration of the liquid detergent composition in the wash water is on the order of about 0.2%. Usually, the proportion of the liquid composition in the wash solution will range from about 0.05 to 0.3%, preferably from 0.15 to 0.25% The proportions of the various constituents of the liquid composition may vary accordingly. Equivalent results can be obtained by using greater proportions of a more dilute formulation but the greater quantity need will require additional packaging and will generally be less convenient for consumer use.

EXAMPLE 1

Enzyme-containing built liquid detergent compositions A–E were formulated as set forth below in Table 1. The percentages shown indicate weight percent.

TABLE 1

| | A | B | C | D | E |
|---|---|---|---|---|---|
| Sodium dodecylbenzene sulfonate | 7% | 7% | 7% | 7% | 7% |
| Ethoxylated $C_{12}$–$C_{15}$ alcohol sulfate (3 mole EO/mole alcohol)(1) | 7 | 7 | 7 | 7 | 7 |
| Brightener | 0.2 | 0.2 | 0.2 | 0.2 | 0.2 |
| Sodium Nitriliotriacetate | 15 | 15 | 15 | 15 | 15 |
| PBB(2) | 1 | 1 | 1 | 1 | 1 |
| Perfume | 0.3 | 0.3 | 0.3 | 0.3 | 0.3 |
| Protease enzyme(3) | 1 | 1 | 1 | 1 | 1 |
| Propylene glycol | — | 20 | 20 | 20 | 20 |
| Borax | — | — | 1 | 2 | 3 |
| $H_2O$ | | | balance | | |
| Percent active enzyme after | | | | | |
| (a) 4 days at 110° F. | — | — | — | — | 98% |
| (b) 6 days at 110° F. | 0 | 15 | 61 | 86 | 88 |

(1)Neodol 25-3S sold by Shell Oil Company.
(2)Polar Brilliant Blue - a 1% active dye solution.
(3)"Esperase" sold by Novo Industries containing 5% enzyme, 75% propylene glycol, and balance $H_2O$ having an activity of 8.0 KNPU/gm. (Kilo Novo Protease units/gm).

The enzyme activities of compositions A–E were tested after 6 days storage at 110° F., the percent activity relative to the initial value being indicated in Table 1. The activity after 4 days was measured only for composition E. Compositions A and B were the only compositions which did not contain an enzyme stabilizing system in accordance with the invention, and manifested a total (composition A) or near total (composition B) loss of enzyme activity after 6 days. Compositions C, D and E reflect the marked improvement of enzyme stability attendant to the inclusion of propylene glycol and borax in the detergent composition.

Compositions B through E were all clear, single-phase, homogeneous solutions which maintained their physical stability and clarity after 6 months of storage at both room temperature and at 110° F. Composition A which was not in accordance with the invention was physically unstable due to the absence of propylene glcyol which in addition to serving as an enzyme stabilizer (in conjunction with the aforementioned boron compound) promotes the solubility of the anionic detergents and the NTA builder in the aqueous composition.

EXAMPLE 2

Enzyme-containing built liquid detergent compositions F and G were formulated essentially similar to compositions A–E except that sodium citrate was used as the builder salt instead of sodium NTA. The compositions are shown below in Table 2.

TABLE 2

| | F | G |
|---|---|---|
| Sodium dodecyl benzene sulfonate | 7% | 7% |
| Ethoxylated $C_{12}$–$C_{15}$ alcohol sulfate (3 moles EO/mole alcohol) | 7 | 7 |
| Brightener | 0.2 | 0.2 |
| Sodium citrate | 12 | 12 |
| PBB(1) | 1 | 1 |
| Perfume | 0.3 | 0.3 |
| Protease enzyme(2) | 1 | 1 |
| Propylene glycol | 20 | 20 |
| Borax | — | 2 |
| $H_2O$ | balance | |
| Percent active enzyme after 4 days at 110° F. | 20 | 95 |

(1)Polar Brilliant Blue - a 1% active dye solution.
(2)"Esperase" sold by Novo Industries containing 5% enzyme, 75% propylene glycol, and balance $H_2O$ having an activity of 8.0 KNPU/gm. (Kilo Novo Protease units/gm).

Composition G in accordance with the invention manifested an enzyme activity after four days of 95% as compared to composition F which contained no boron compound and consequently lost more than ¾ of its initial enzyme activity.

Both compositions were clear single-phase solutions which remained physically stable after six months of storage at both room temperature and 110° F.

EXAMPLE 3

Enzyme-containing built liquid detergent compositions H, I and J were formulated essentially similar to compositions F and G in Example 2 except that they contained a mixture of protease and alpha-amylase enzymes instead of a single protease enzyme. The compositions are shown below in Table 3.

TABLE 3

| | H | I | J |
|---|---|---|---|
| Sodium dodecyl benzene sulfonate | 7% | 7% | 7% |
| Ethoxylated $C_{12}$–$C_{15}$ alcohol sulfate (3 moles EO/mole alcohol) | 7 | 7 | 7 |
| Brightener | 0.2 | 0.2 | 0.2 |
| Sodium citrate | 12 | 12 | 12 |
| PBB[1] | 1 | 1 | 1 |
| Perfume | 0.3 | 0.3 | 0.3 |
| Protease enzyme[2] | 1 | 1 | 1 |
| α-Amylase enzyme[3] | 0.4 | 0.4 | 0.4 |
| Propylene glycol | 20 | 20 | 20 |
| Borax | — | 1 | 3 |
| $H_2O$ | | balance | |
| Percent active enzyme after 4 days at 110° F. | | | |
| α-amylase enzyme | 50% | 67% | 87% |
| Protease enzyme | 30 | 73 | 94 |

[1]Polar Brilliant Blue - a 1% active dye solution.
[2]"Esperase" sold by Novo Industries containing 5% enzyme, 75% propylene glycol, and balance $H_2O$ having an activity of 8.0 KNPU/gm. (Kilo Novo Protease units/gm).
[3]"Termamyl" sold by Novo Industries containing 5% enzyme, 18% Nacl and balance $H_2O$ having an activity of 120,000 Novo amylase units per gram.

Compositions I and J in accordance with the invention demonstrated a markedly more stable enzyme activity after four days for both the protease and amylase enzymes relative to composition H which contained no boron compound and consequently lost about ½ of its initial amylolytic activity and about ⅓ of its initial proteolytic activity during the period of four days.

All three compositions were clear single-phase solutions which remained physically stable after six months of storage.

What is claimed is:

1. A stabilized aqueous, built, clear single-phase, enzyme-containing liquid detergent composition comprising:
   (a) from about 8 to 20%, by weight, of one or more surface active anionic detergent compounds;
   (b) from about 5 to 25%, by weight, of a water-soluble non-phosphate detergent builder salt;
   (c) an effective amount of an enzyme or enzyme mixture selected from the group consisting of alkaline protease enzymes and alpha-amylase enzymes;
   (d) an enzyme stabilizing system containing, based on the weight of the detergent composition, (i) from about 12 to 25% of propylene glycol and (ii) from about 1 to 5% of a boron compound selected from the group consisting of boric acid, boric oxide and alkali metal borates; and
   (e) from about 25 to 75%, by weight, water, said liquid detergent composition being substantially free of cross-linked polyacrylates polymers.

2. A detergent composition according to claim 1 wherein said builder salt is sodium citrate.

3. A detergent composition according to claim 1 wherein said builder salt is sodium nitrilotriacetate.

4. A detergent composition according to claim 1 which is substantially free of a phosphate detergent builder salt.

5. A detergent composition according to claim 1 which contains from about 15 to 20%, by weight, of propylene glycol and from about 1 to 3%, by weight, of said boron compound.

6. A detergent composition in accordance with claim 1 wherein said boron compound is borax.

7. A detergent composition in accordance with claim 1 wherein said builder salt is present in an amount of from about 10 to 20%, by weight.

8. A detergent composition according to claim 1 wherein the anionic detergent is a mixture of a $C_{10}$–$C_{18}$ alkyl benezene sulfonate salt and a polyethoxylated $C_{10}$–$C_{18}$ alcohol sulfate salt.

9. A method of laundering comprising contacting the stained and/or soiled fabrics to be laundered with an enzyme-containing, built, clear single-phase liquid detergent composition comprising;
   (a) from about 8 to 20%, by weight, of one or more surface active anionic detergent compounds;
   (b) from about 5 to 25%, by weight, of a water-soluble non-phosphate detergent builder salt;
   (c) an effective amount of an enzyme or enzyme mixture selected from the group consisting of alkaline protease enzymes and alpha-amylase enzymes;
   (d) an enzyme stabilizing system containing, based on the weight of the detergent composition, (i) from about 12 to 25% of propylene glycol and (ii) from about 1 to 5% of a boron compound selected from the group consisting of boric acid, boric oxide and alkali metal borates; and
   (e) from about 25 to 75%, by weight, water, said liquid detergent composition being substantially free of cross-linked polyacrylate polymers.

10. A method according to claim 9 wherein said builder salt is sodium citrate.

11. A method according to claim 9 wherein said builder salt is sodium nitrilotriacetate.

12. A method according to claim 9 wherein said detergent composition is substantially free of a phosphate detergent builder salt.

13. A method according to claim 9 wherein said detergent composition contains from about 15 to 20%, by weight, of propylene glycol and from about 1 to 3%, by weight, of borax.

14. A method according to claim 9 wherein said detergent composition contains from about 10 to 20% of a non-phosphate builder set.

15. A method according to claim 9 wherein said detergent composition contains a mixture of a $C_{10}$–$C_{18}$ alkyl benzene sulfonate salt and a polyethoxylated $C_{10}$–$C_{18}$ alcohol sulfate salt.

* * * * *